US007780403B2

(12) United States Patent
Fridsma

(10) Patent No.: US 7,780,403 B2
(45) Date of Patent: Aug. 24, 2010

(54) ADJUSTABLE TURBINE EXHAUST FLOW GUIDE AND BEARING CONE ASSEMBLIES

(75) Inventor: Daniel E. Fridsma, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 1005 days.

(21) Appl. No.: 11/518,108

(22) Filed: Sep. 8, 2006

(65) Prior Publication Data

US 2008/0063516 A1 Mar. 13, 2008

(51) Int. Cl.
*F01D 17/14* (2006.01)

(52) U.S. Cl. ..... 415/148; 415/211.2

(58) Field of Classification Search ..... 415/148, 415/150, 208.1, 208.2, 211.2, 225, 22, 226
See application file for complete search history.

(56) References Cited

U.S. PATENT DOCUMENTS 2,587,649 A * 3/1952 Pope ..... 60/698
3,391,869 A * 7/1968 Glass ..... 239/265.19
3,752,597 A 8/1973 Heinold et al.
4,391,564 A * 7/1983 Garkusha et al. ..... 415/126
4,398,865 A 8/1983 Garkusha et al.
5,209,634 A 5/1993 Owczarek
5,257,906 A 11/1993 Gray et al.
6,261,055 B1 7/2001 Owczarek

* cited by examiner

*Primary Examiner*—Edward Look
*Assistant Examiner*—Nathaniel Wiehe

(57) ABSTRACT

An adjustable vane system is provided for use in a turbomachine, including a plurality of movable vanes that may be positioned to change the cross-sectional area of an exhaust flow passage and minimize the pressure of steam adjacent the exit after the last row of rotating turbine blades. Each of the vanes preferably includes an overlapping portion for overlapping a surface of an adjacent vane to minimize leakage of steam along the longitudinal extent of the vane. The exhaust flow passage is defined by inner and outer diffuser members where either of the inner or outer diffuser members may be formed of the movable vanes.

10 Claims, 7 Drawing Sheets

ADJUSTABLE TURBINE EXHAUST FLOW GUIDE AND BEARING CONE ASSEMBLIES

FIELD OF THE INVENTION

The present invention relates to an exhaust system for a turbomachine and, more particularly, to an adjustable guide vane structure including a plurality of movable vanes that may be positioned to change the cross-sectional area and minimize the pressure of steam adjacent the exit after the last row of turbine blades.

BACKGROUND OF THE INVENTION

In typical low-pressure (LP) steam turbines used in power generation, steam leaving the last row of turbine blades flows through an annulus or exhaust flow passage between a bearing cone, surrounding an outer portion of the turbine shaft at the hub of the last-stage blades, and an exhaust flow guide extending from the cylinder structure surrounding the turbine blades and located adjacent the tip of the last-stage blades. The performance of a steam turbine may generally be improved by lowering the back pressure to which the last-stage blades of the turbine is subjected. Consequently, turbines often discharge to a condenser in which a sub-atmospheric pressure is maintained.

The exhaust steam discharging axially from the last-stage blades is typically directed to a condenser mounted below the turbine by turning the flow 90° from the axial to the vertically downward direction. The inner surface of the exhaust flow guide and the outer surface of the turbine bearing cone form a shape for the exhaust flow passage in which the steam passing from the last-stage turbine blades is preferably decelerated or, in other words, diffused. The diffusion causes a decrease in kinetic energy of the steam and a corresponding increase in pressure from the last-stage turbine blades to the exhaust flow passage exit. This exhaust flow passage exit pressure is influenced by the pressure in the condenser located after the exhaust hood. Since with diffusion there is an increase, in the flow direction, of steam pressure in the exhaust flow passage, there is a corresponding decrease in pressure of the steam at the exit of the last-stage turbine blades below the condenser pressure, called a negative hood loss, and a corresponding increase in turbine work output as compared to the work output which would occur in the absence of diffusion. Accordingly, an LP turbine provided with a diffuser can produce more power than if the diffuser was absent. However, for a fixed shape of the exhaust flow guide and the bearing cone, the performance of the passage is optimum at only one set of thermodynamic conditions.

The performance of the diffuser, as determined by a given shape of the exhaust flow guide and the bearing cone, and thus the performance of the LP turbine, is substantially affected by the pressure at the condenser. Further, the pressure at the condenser is largely a function of the ambient weather conditions, where the condenser pressure (also called back pressure) is typically higher in the summer months and lower in the winter months. For a given flow rate, the performance of the exhaust passage for a fixed-shape exhaust flow guide and bearing cone is optimum at only one value of back pressure. As the back pressure increases or decreases with seasonal changes, the performance of the exhaust passage becomes non-optimum. Non-optimum hood losses may be smaller negative values or the hood losses may rise into the positive range. For a positive hood loss, the exhaust passage no longer acts as a diffuser and the pressure at the exit of the last-stage blades is greater than the condenser pressure. It is often the case that a typical base-loaded steam turbine produces less power in the summer months than in the winter months. Accordingly, it is desirable to reduce hood losses in order to generate more power in the summer months. In order to accomplish this, it has been found desirable to make the shapes of the exhaust flow guide and/or the bearing cone variable or adjustable so that performance can be optimized for changing thermodynamic conditions.

U.S. Pat. No. 5,209,634 discloses an adjustable guide vane assembly in which adjustable vanes may be provided to change the cross-sectional area of an exhaust flow passage after the last row of turbine blades to control and minimize the pressure of the steam exiting the last row blades. It is noted that pivoted vane segments are disclosed located adjacent each other. A gap may form between edges of adjacent vanes of the vane segments which may permit flow of steam radially outwardly along the exhaust flow passage and potentially decrease the effectiveness of the exhaust flow passage.

SUMMARY OF THE INVENTION

In accordance with the present invention, an adjustable vane system is provided for use in a turbomachine, including a plurality of movable vanes that may be positioned to change the cross-sectional area and minimize the pressure of steam adjacent the exit after the last row of turbine blades. Each of the vanes preferably includes an overlapping portion for overlapping a surface of an adjacent vane to minimize leakage of steam along the longitudinal extent of the vane.

In accordance with one aspect of the invention, an adjustable vane system is provided for use in a turbomachine having a shaft extending longitudinally of the turbomachine, a plurality of rows of turbine blades mounted transversely of the shaft, a bearing cone surrounding an outer portion of the shaft, and an exhaust flow passage comprising inner and outer walls. The adjustable vane system comprises a plurality of movable vanes defining at least a portion of one of the inner or outer walls of the exhaust flow passage, each of the vanes comprising a vane surface defined by a pair of longitudinal edges extending in an axial direction and a transverse edge extending between the longitudinal edges. A hinge structure supports the vanes for movement between at least a first position and a second position to change the cross-sectional area of the exhaust flow passage. At least one longitudinal edge of each of the vanes is located in overlapping relation to the vane surface of an adjacent vane.

In accordance with another aspect of the invention, an adjustable vane system is provided in a steam turbine having a shaft extending longitudinally of the turbine, a plurality of rows of turbine blades mounted transversely of the shaft, a cylinder structure surrounding the turbine blades, a bearing cone surrounding an outer portion of the shaft, and an exhaust flow passage comprising inner and outer walls. The adjustable vane system comprises a plurality of movable vanes defining at least a portion of one of the inner or outer walls of the exhaust flow passage, each of the vanes comprising a vane surface defined by a pair of longitudinal edges extending in an axial direction and a transverse edge extending between the longitudinal edges. A hinge structure supports the vanes for movement between at least first and second positions to modify the pressure of steam adjacent the exit of the last row of turbine blades. At least one longitudinal edge of each of the vanes is located in overlapping relation to the vane surface of an adjacent vane when the vanes are in the first and second positions.

In accordance with a further aspect of the invention, an adjustable vane system is provided for use in a turbomachine having a shaft extending longitudinally of the turbomachine, a plurality of rows of turbine blades mounted transversely of the shaft, a cylinder structure surrounding the turbine blades, a bearing cone surrounding an outer portion of the shaft, and an exhaust flow passage comprising inner and outer walls. The adjustable vane system comprises a plurality of movable vanes defining at least a portion of the outer wall of the exhaust flow passage, each of the vanes comprising a vane surface defined by a pair of longitudinal edges extending in an axial direction and a transverse edge extending between the longitudinal edges. A hinge structure supports the vanes at the cylinder structure for movement between at least first and second positions to change the cross-sectional area of the exhaust flow passage. A movable collar extends around at least a portion of the cylinder structure and a link structure extends between the collar and the vanes wherein movement of the collar actuates the vanes to move between the first and second positions.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
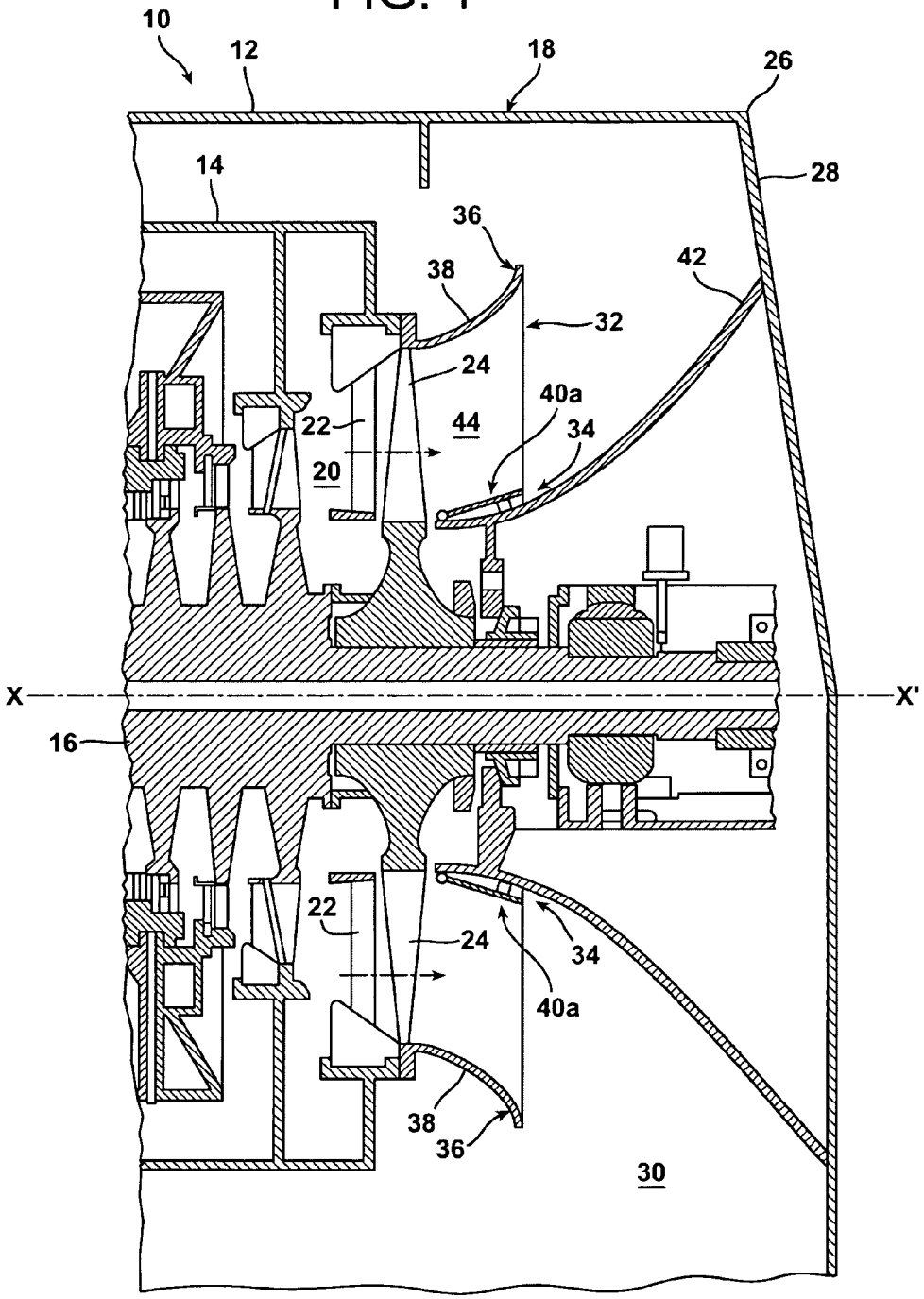
FIG. 1 is a longitudinal cross-sectional view through a portion of a low pressure steam turbine incorporating an adjustable vane system in accordance with a first embodiment of the invention, where an inner diffuser member is defined by movable vanes.

Referring to FIG. 1, a longitudinal cross-section of the right half of a low pressure steam turbine 10 with a downward exhaust is illustrated. The primary components of the steam turbine 10 are an outer cylinder 12, an inner cylinder 14 enclosed by the outer cylinder 12, a centrally disposed rotor or shaft 16 enclosed by the inner cylinder 14 and an exhaust system 18. The shaft 16 extends along a longitudinal axis X-X' of the turbine 10, and the inner cylinder 14 and shaft 16 form an annular steam flow path 20 therebetween, the inner cylinder 14 forming the outer periphery of the steam flow path 20. A plurality of stationary blades 22 and rotating blades 24, each of which has an airfoil portion, are arranged in alternating rows and extend into the steam flow path 20. The stationary blades 22 are affixed to the inner cylinder 14 and the rotating blades 24 are affixed to the periphery of the shaft 16.

The exhaust system 18 comprises an exhaust housing 26 formed by an end wall 28 connected to the outer cylinder 12. An outlet 30 is formed in the bottom of the exhaust housing 26 and is connected to a condenser (not shown). An exhaust diffuser 32 is disposed within the exhaust housing 26. The exhaust diffuser 32 is formed by an inner diffuser member 34 and an outer diffuser member 36 wherein the inner and outer diffuser members 34, 36 comprise approximately frusto-conical members defining inner and outer walls, respectively, of the exhaust diffuser 32.

The diffuser 32 shown in FIG. 1 illustrates a first embodiment of the invention, where the outer diffuser member 36 is formed by a fixed flow guide 38 attached to the inner cylinder 14, and the inner diffuser member 34 is formed by an adjustable vane system 40*a* supported at a bearing cone 42 surrounding an outer portion of the shaft 16, as is described further below. The inner and outer diffuser members 34, 36 each extend for 360° about the shaft 16 and form a substantially annular diffusing or exhaust flow passage 44 therebetween. In addition, the fixed flow guide 38 and bearing cone 42 may be formed of upper and lower halves joined at flanges (not shown) located longitudinally along a plane extending through the longitudinal axis X-X' in a manner known in the art. The rotating blades 24 in the last row of blades, i.e., the rotating blades 24 in the row that is farthest downstream, are disposed just upstream of the fixed flow guide 38.

Figure 2:
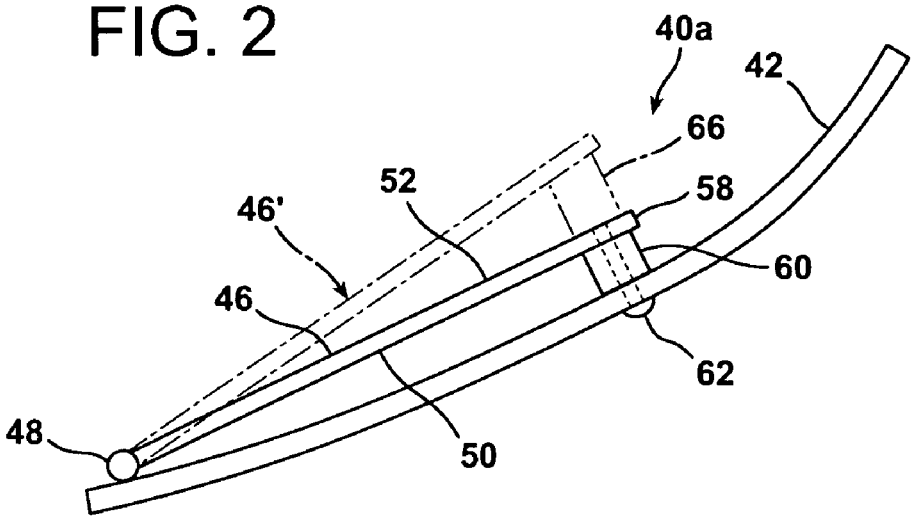
FIG. 2 is an enlarged side view of a movable vane in the adjustable vane system of FIG. 1, showing two alternative positions for the movable vane.
Figure 3:
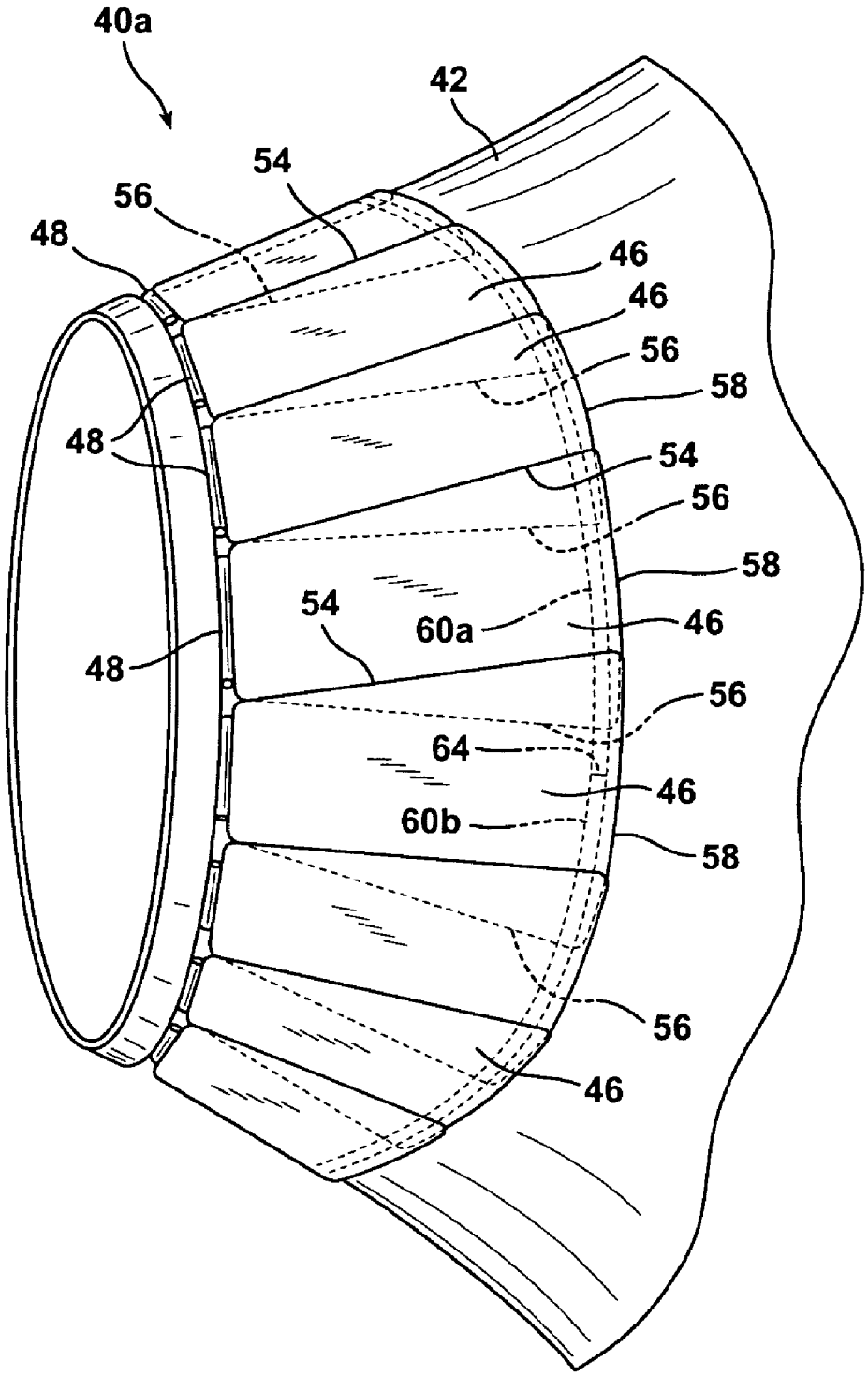
FIG. 3 is an enlarged fragmentary perspective view of an inner diffuser member of the exhaust flow passage for the turbine of FIG. 1, showing the adjustable vane system supported on the bearing cone for the turbine.

Referring further to FIGS. 2-3, the adjustable vane system 40*a* comprises a plurality of movable vanes 46 mounted at the bearing cone 42 by a hinge structure comprising transversely extending hinges 48 pivotally supporting the vanes 46 for movement in a radial direction relative to the bearing cone 42. The vanes 46 each include an inner vane surface 50 and an outer vane surface 52, where the vane surfaces 50, 52 are defined between first and second longitudinal edges 54 and 56, and a transverse edge 58 extending between the longitudinal edges 54, 56.

The longitudinal edges 54, 56 diverge away from each other in the downstream direction of the exhaust flow passage 44, such that the width of the vanes 46 increases in the direction extending from the hinges 48. The first longitudinal edge 54 of each vane 46 is located radially outwardly from and in overlapping relationship to the outer surface 52 of an adjacent vane 46. Similarly, the second longitudinal edge 56 of each vane 46 is located radially inwardly from and in overlapping relationship to the inner surface 50 of an adjacent vane 46. Accordingly, as the vanes 46 pivot about the hinges 48, a portion of the inner surface 50 of each vane 46 will be in substantially overlapping relationship with a portion of the outer surface 52 of an adjacent vane 46 to define a sealing area at a location of relative movement between the adjacent vanes 46 to limit or substantially prevent passage of steam from the exhaust flow passage 44 radially past the longitudinal edges 54, 56. The shape of the edges 54, 56 is preferably configured to conform to the shape of the adjacent respective surfaces 52, 50 such that the edges 54, 56 and surfaces 52, 50 will be in closely adjacent or contacting relationship to each other to form a substantially sealed surface about the circumference of the adjustable vane system 40*a*.

As best seen in FIG. 2, the vanes 46 may be supported in a selected radial position by a circumferentially extending support collar 60 that is attached to the bearing cone 42 downstream from the hinges 48 by any conventional means, such as by fasteners 62 extending through the bearing cone 42 and collar 60. The collar 60 may be formed as a segmented structure, as illustrated by a joint 64 between an upper collar segment 60*a* and lower collar segment 60*b* in FIG. 3, to facilitate installation and removal of the collar 60 to the bearing cone 42. The vanes 46 may be held to the collar 60 by means of the fasteners 62 extending through the collar 60 to the vanes 46, as illustrated in FIG. 2, or by other or additional means (not shown) forming a connection between the vanes 46 and the collar 60. Preferably the connection between the vanes 46 and the collar 60 permits axial thermal expansion of the vanes 46, such as by providing a slot connection between the vanes 46 and respective fasteners 62.

The vanes 46 may be supported at an alternative radial position relative to the bearing cone 42, illustrated by the vane 46' shown in phantom, by providing an alternative support collar 66. The alternative support collar 66 may comprise a second support collar having a thickness or radial height greater than the radial height of the support collar 60. Optionally, the alternative support collar 66 may comprise a collar extender mounted to the radially outer side of the support collar 60 to provide an increased radial height comprising the combined height of the support collar 60 and the alternative support collar 66. The position of the vanes 46' provided by the alternative support collar 66 reduces the cross-sectional area at the exit to the exhaust flow passage 44 to modify the pressure of steam adjacent the last row of rotating turbine blades 24. It should be understood that any number of support collars 60 or alternative support collars 66 may be provided, having different height dimensions, to permit adjustment of the vanes 46 to a plurality of predetermined radial positions.

Referring to FIGS. 4-7, a second embodiment of the invention is illustrated, where elements of the second embodiment corresponding to elements previously described in the first embodiment are labeled with the same reference numerals increased by 100.

Figure 4:
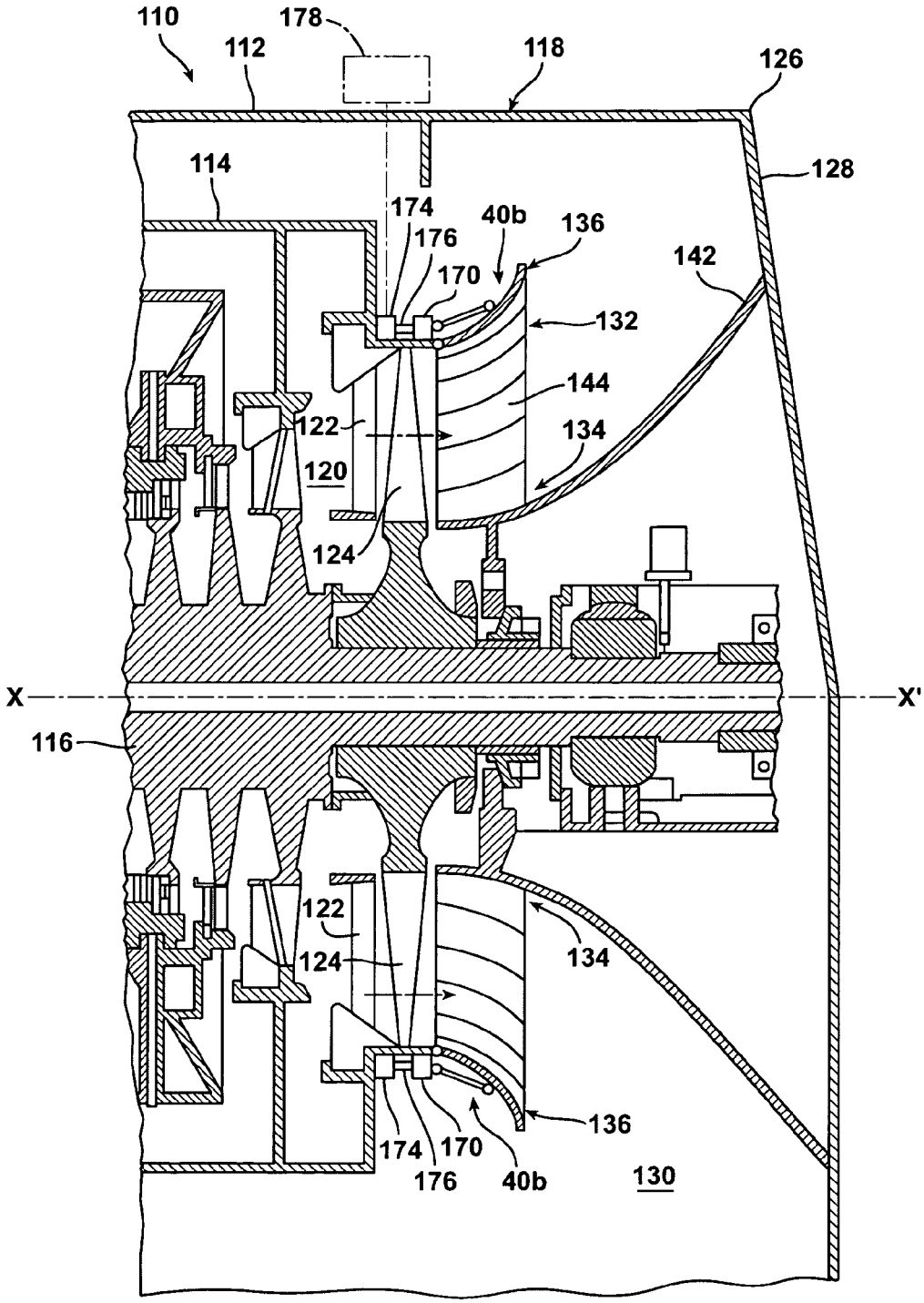
FIG. 4 is a longitudinal cross-sectional view through a portion of a low pressure steam turbine incorporating an adjustable vane system in accordance with a second embodiment of the invention, where an outer diffuser member is defined by movable vanes.

The diffuser 132 shown in FIG. 4 includes an inner diffuser member 134 defined by a bearing cone 142 and an outer diffuser member 136 formed by an adjustable vane system 40*b* supported at an inner cylinder 114 adjacent the last row of rotating blades 124. The inner and outer diffuser members 134, 136 each extend for 360° about the shaft 116 and form a substantially annular exhaust flow passage 144 therebetween.

Figure 5:
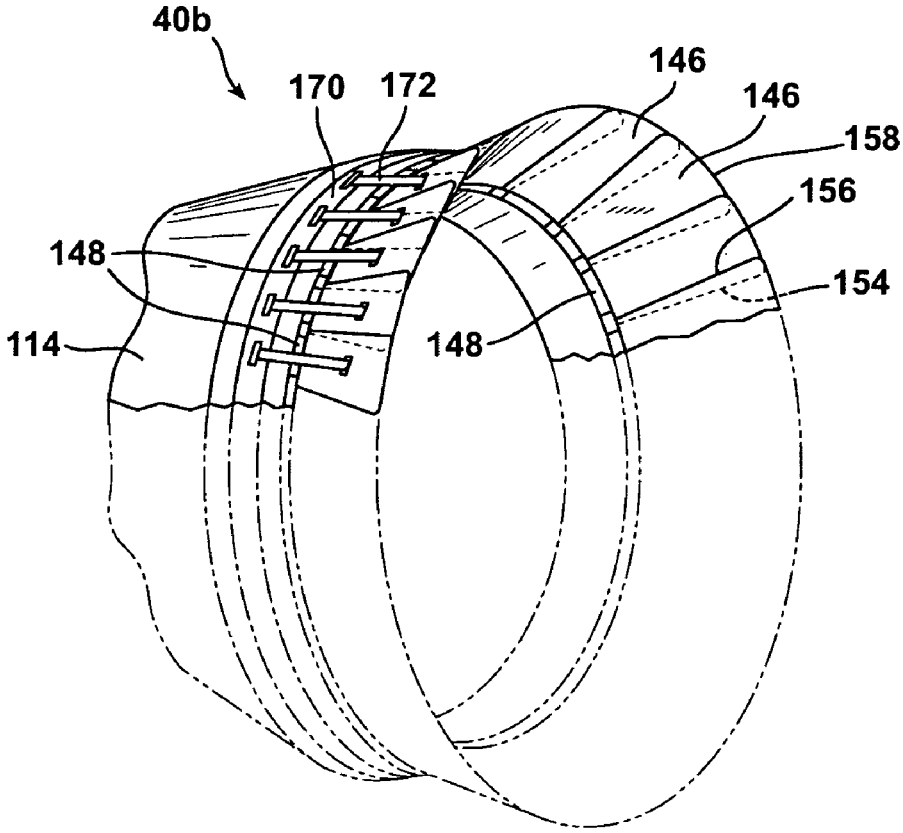
FIG. 5 is an enlarged fragmentary perspective view of an outer diffuser member of the exhaust flow passage for the turbine of FIG. 4, showing the adjustable vane system supported on the inner cylinder for the turbine.
Figure 6:
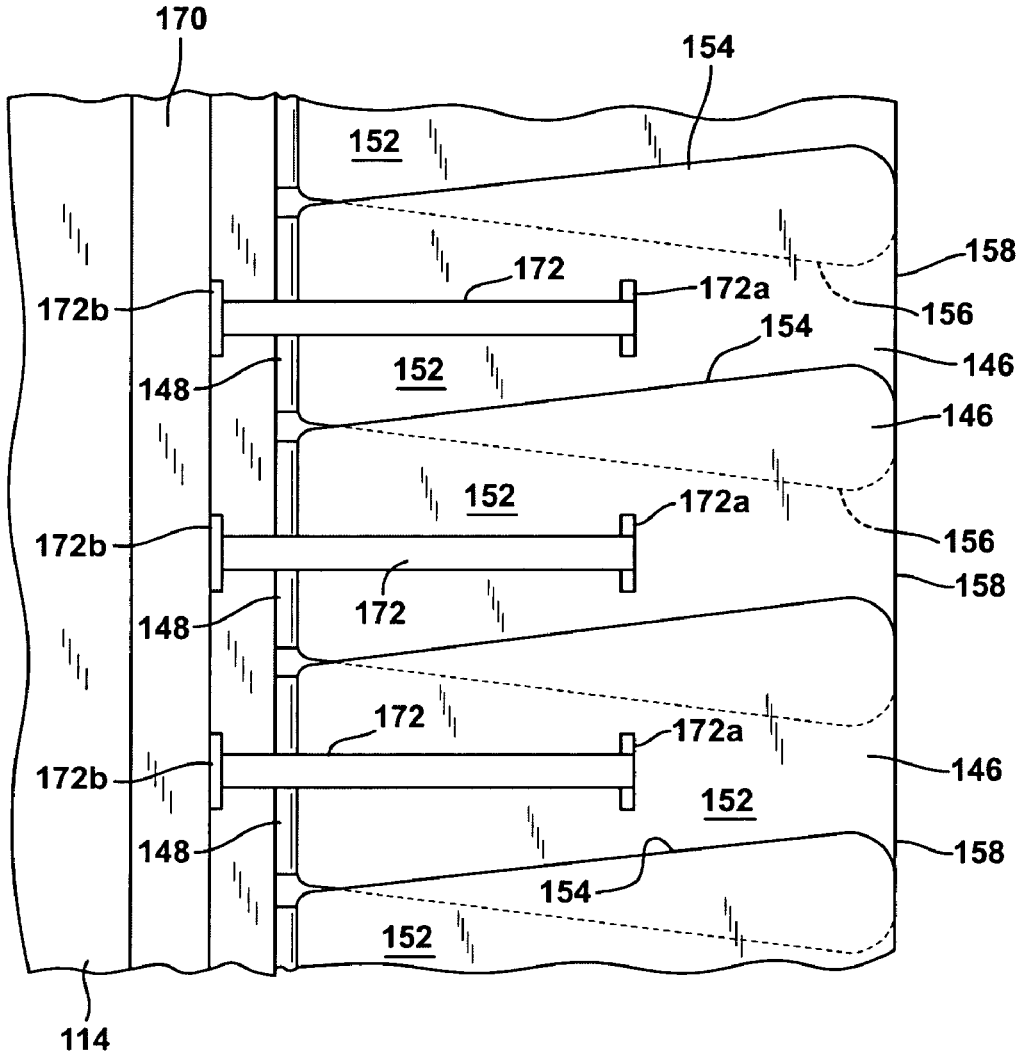
FIG. 6 is a plan view of a portion of the outer diffuser member defined by the movable vanes of the turbine of FIG. 4.

As seen in FIGS. 5 and 6, the adjustable vane system 40*b* comprises a plurality of vanes 146 mounted at the inner cylinder 114 by a hinge structure comprising transversely extending hinges 148 pivotally supporting the vanes 146 for movement in a radial direction relative to the bearing cone 142. The vanes 146 each include an inner vane surface 150 and an outer vane surface 152 (FIG. 7), where the vane surfaces 150, 152 are defined between first and second longitudinal edges 154 and 156, and a transverse edge 158 extending between the longitudinal edges 154, 156.

The longitudinal edges 154, 156 diverge away from each other in the downstream direction of the exhaust flow passage 144, such that the width of the vanes 146 increases in the direction extending from the hinges 148. The first longitudinal edge 154 of each vane 146 is located radially outwardly from and in overlapping relationship to the outer surface 152 of an adjacent vane 146. Similarly, the second longitudinal edge 156 of each vane 146 is located radially inwardly from and in overlapping relationship to the inner surface 150 of an adjacent vane 146. Accordingly, as the vanes 146 pivot about the hinges 148, a portion of the inner surface 150 of each vane 146 will be in substantially overlapping relationship with a portion of the outer surface 152 of an adjacent vane 146 to define a sealing area at a location of relative movement between the adjacent vanes 146 to limit or substantially prevent passage of steam from the exhaust flow passage 144 radially past the longitudinal edges 154, 156. The shape of the edges 154, 156 is preferably configured to conform to the shape of the adjacent respective surfaces 152, 150 such that the edges 154, 156 and surfaces 152, 150 will be in closely adjacent or contacting relationship to each other to form a substantially sealed surface about the circumference of the adjustable vane system 40*b*.

Figure 7:
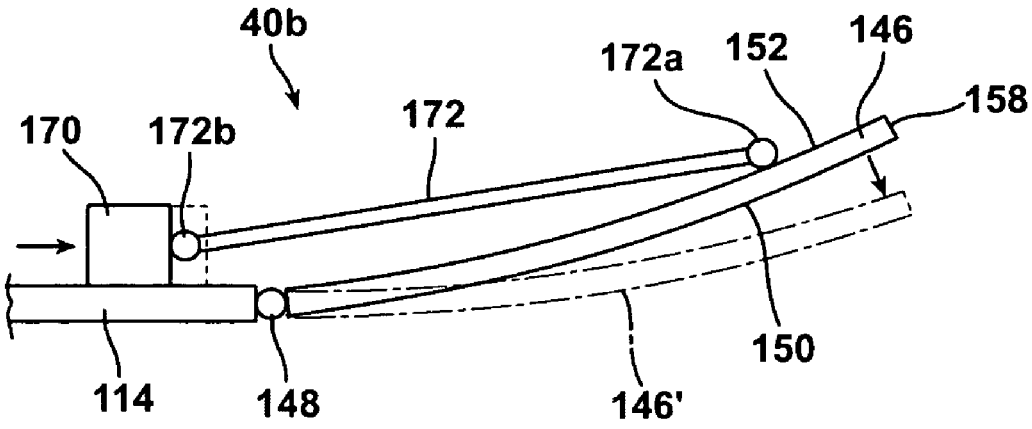
FIG. 7 is an enlarged side view of a movable vane in the adjustable vane system of FIG. 4, showing two alternative positions for the movable vane.

Referring to FIGS. 6 and 7, the vanes 146 may be actuated for movement to selected radial positions by an actuator structure comprising a collar 170 extending around the inner cylinder 114. The vanes 146 are connected to the collar 170 by a link structure including a plurality of links 172 where, in the illustrated embodiment, each link 172 may extend from a transverse hinge connection 172*a* on a respective vane 146 to a transverse hinge connection 172*b* on the collar 170 at the inner cylinder 114. The collar 170 is supported for axial movement along the inner cylinder 114 for actuating the vanes 146 to pivot radially about the hinges 148. For example, the vanes 146 may be actuated to pivot from a first position, illustrated by the vane 146 in FIG. 7, defining a first cross-sectional area of the exhaust flow passage 144, to a second position, illustrated by the vane 146' shown in phantom, to define a second cross-sectional area of the exhaust flow passage 144 different from the first cross-sectional area.

The collar 170 may be actuated for axial movement by a drive unit 174, such as a linear actuator depicted diagrammatically in FIG. 4, connected via a rod 176 to the collar 170. The drive unit 174 may be operated under control of a controller 178 located outside of the outer cylinder 112. It should be understood that although only one drive unit 174 is illustrated for actuating the collar 170 in axial movement, a plurality of similar drive units 174 may be provided around the circumference of the inner cylinder 114 to actuate the collar 170.

Figure 8:
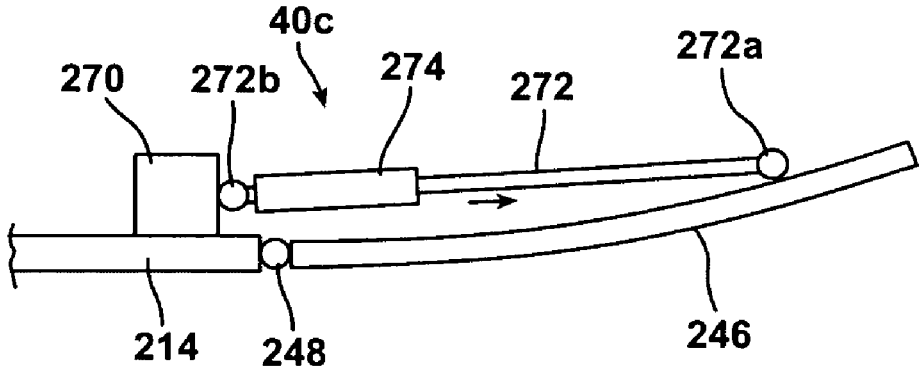
FIG. 8 is a third embodiment of the invention, showing an enlarged side view similar to FIG. 7, and including an alternative actuation mechanism for actuating the movable vanes of the second embodiment in pivotal movement.

FIG. 8 illustrates a third embodiment including an adjustable vane system 40*c* that is a variation on the second embodiment where elements of the third embodiment corresponding to elements previously described for the second embodiment are labeled with the same reference numerals increased by 100. The invention in accordance with the third embodiment comprises a plurality of vanes 246 (only one shown) which are supported to the inner cylinder 214 by transversely extending hinges 248 in the same manner as described above for the vanes 146. The vanes 246 are connected by a link structure to a collar 270 supported on the inner cylinder 214, where the link structure comprises a plurality of links 272 (only one shown), each link 272 extending from a hinge connection 272*a* on a respective vane 246 to a hinge connection 272*b* on the collar 270. The collar 270 is supported in stationary relationship to the inner cylinder 214, and each link 272 includes a drive unit 274, such as a linear hydraulic actuator. The drive unit 274 operates to change the length of the link 272 to actuate the vane 246 to pivot in a radial direction about the hinge 248.

Figure 9:
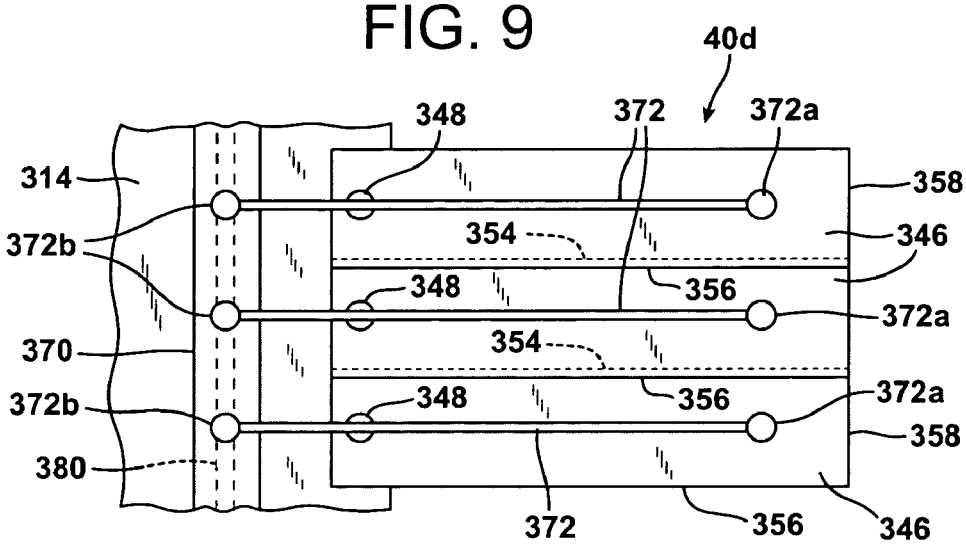
FIG. 9 is a fourth embodiment of the invention, showing a plan view of a portion of the outer diffuser member defined by movable vanes and supported for pivotal movement about radial axes.
Figure 10:
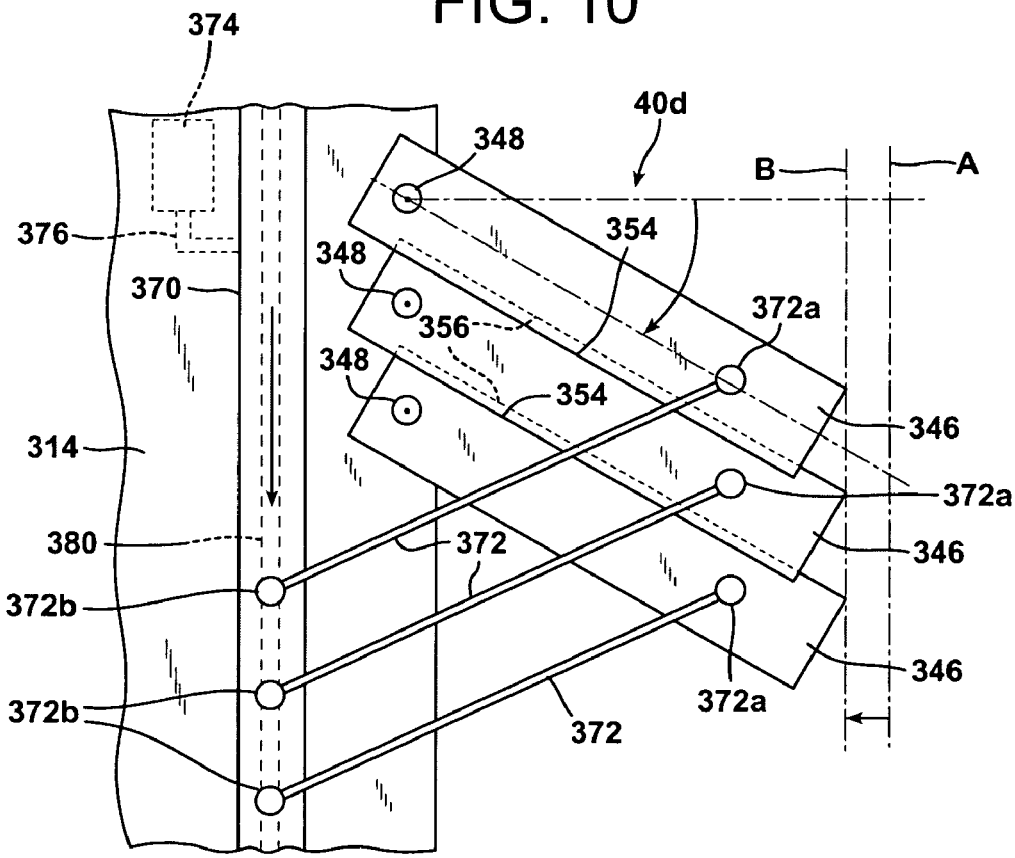
FIG. 10 is a view similar to FIG. 9 in which the vanes have been moved to a second, transversely pivoted position to change the axial length of the outer diffuser member.

FIGS. 9 and 10 illustrate a fourth embodiment of the invention including an adjustable vane system 40*d*, where elements of the fourth embodiment corresponding to elements previously described in the second embodiment are labeled with the same reference numerals increased by 200.

The adjustable vane system 40*d* comprises a plurality of vanes 346 (only three shown) mounted to the inner cylinder 314 at respective radially extending hinges 348 for pivotal movement in a transverse direction. Each vane comprises a first longitudinal edge 354 and a second longitudinal edge 356. The longitudinal edges 354, 356 are shown extending parallel to each other and are connected by a transverse edge 358. However, it should be understood that the longitudinal edges 354, 356 may extend in diverging relationship to each other, as in the previous embodiments, to provide a predetermined overlap of the edges 354, 356 of the vanes 346 when the vanes 346 are located in the position of FIG. 9. As the vanes 346 move to the pivoted position of FIG. 10, the angular position of the vanes 346 locates the edges 354, 356 in overlapping relationship to adjacent surfaces of adjacent vanes 346 such that the edges 354, 356 and respective adjacent surfaces will be in closely adjacent or contacting relationship to each other to maintain a substantially sealed surface about the circumference of the adjustable vane system 40*d*.

The vanes 346 are connected to a collar 370 by a link structure comprising a plurality of links 372, where each link 372 extends from a radial hinge connection 372*a* on a respective vane 346 to a radial hinge connection 372*b* on the collar 370 at the inner cylinder 314. The collar 370 is engaged with the inner cylinder 314 at a thread connection 380 extending around the inner cylinder 314, and the collar 370 is supported for rotational movement about the inner cylinder 314. Rotation of the collar 370 about the inner cylinder 314 causes the links to pivot the vanes 346 in transverse pivotal movement about the hinges 348, resulting in the axial length of the outer wall of the exhaust flow passage defined by the vanes 346 becoming shorter. The change in length of the outer wall is illustrated in FIG. 10 by dotted lines A and B, where line A illustrates the fully extended position of the vanes 346 and line B illustrates a retracted position of the vanes 346. The change in length of the outer wall defined by the vanes 346 effectively changes a distance between the transverse edges 358 of the vane 346 and the tapered bearing cone, see for example the bearing cone 142 in FIG. 4, to change the cross-sectional area of the exhaust flow passage, as is additionally described in U.S. Pat. No. 5,209,634, which patent is incorporated herein by reference. The collar 370 may be actuated for movement by a drive unit 374, illustrated diagrammatically as a linear actuator, connected to the collar 370 by a rod 376 and providing movement in the transverse direction to rotate the collar 370 relative to the inner cylinder 314. It should be understood that a plurality of similar drive units 374 may be provided around the circumference of the inner cylinder 314 to actuate the collar 370.

Means for actuating movement of the vanes 46, 146, 246, 346 other than those described herein may be provided for locating the vanes 46, 146, 246, 346 to different positions. For example, the overlapping vanes 46, 146, 246, 346 of the present invention may be actuated for movement by any of the actuating means disclosed in the above-noted U.S. Pat. No. 5,209,634. Further, it should be noted that the radially movable overlapping vanes 46, 146, 246 of the first, second and third embodiments are positioned in sliding overlapping engagement with adjacent vanes such that radial pivotal movement of any given vane may operate to actuate an adjacent vane in radial pivotal movement. Accordingly, with reference to the disclosed link structure of the second and third embodiments, the adjustable vane systems 40*b* and 40*c* may be constructed such that some of the vanes 146, 246 are not required to have an actuating link, but may be actuated by movement of an adjacent vane.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An adjustable vane system for use in a turbomachine having a shaft extending longitudinally of said turbomachine, a plurality of rows of turbine blades mounted transversely of said shaft, a bearing cone surrounding an outer portion of said shaft, and an exhaust flow passage comprising inner and outer walls, the adjustable vane system comprising:

a plurality of movable vanes defining at least a portion of said outer wall of said exhaust flow passage, each said vane comprising a vane surface defined by a pair of longitudinal edges extending in an axial direction and a transverse edge extending between said longitudinal edges;

a hinge structure pivotally supporting said vanes at a cylinder structure surrounding said turbine blades, and said hinge structure supporting said vanes for movement between at least a first position and a second position to change the cross-sectional area of the exhaust flow passage;

an axially movable member supported adjacent to a radially outer surface of said cylinder structure for axial movement along said cylinder structure;

a plurality of link members, each said link member connected to a respective vane at a first hinge connection at a first end of said link member, and each said link member connected to said axially movable member at a second hinge connection at a second end of said link member, wherein axial movement of said axially movable member actuates said vanes in pivotal movement;

at least one actuator connected to said axially movable member for actuating said axially movable member in axial movement to effect pivotal movement of said vanes via pivotal movement at said first and second hinge connections of said link members; and wherein at least one longitudinal edge of each of said vanes is located in overlapping relation to the vane surface of an adjacent vane.

2. The adjustable vane system of claim 1, wherein a width of each of said vanes, comprising a transverse dimension extending between said longitudinal edges, increases extending in a direction away from said hinge structure.

3. The adjustable vane system of claim 1, wherein movement of said axially movable member axially along said cylinder structure causes said vanes to pivot radially about said hinge structure from said first position, defining a first cross-sectional area of said exhaust flow passage, to said second position, said second position defining a second cross-sectional area of said exhaust flow passage different than said first cross-sectional area.

4. The adjustable vane system of claim 1, wherein said first hinge connections between said link members and respective ones of said vanes are located on said vanes between said hinge structure and said transverse edges of said vanes, distal from said hinge structure.

5. The adjustable vane system of claim 1, wherein said axially movable member comprises an axially movable collar extending around and supported on said radially outer surface of said cylinder structure for axial sliding movement along said cylinder structure, and said second ends of said link members are connected to said movable collar at said second hinge connections located on said movable collar.

6. In a steam turbine having a shaft extending longitudinally of said turbine, a plurality of rows of turbine blades mounted transversely of said shaft, a cylinder structure surrounding said turbine blades, a bearing cone surrounding an outer portion of said shaft, and an exhaust flow passage comprising inner and outer walls, an adjustable vane system comprising:

a plurality of movable vanes defining at least a portion of said outer wall of said exhaust flow passage, each said vane comprising a vane surface defined by a pair of longitudinal edges extending in an axial direction and a transverse edge extending between said longitudinal edges;

a hinge structure pivotally supporting said vanes at said outer wall for radial movement between at least first and second positions to modify the pressure of steam adjacent the exit of the last row of turbine blades;

an axially movable collar extending around and supported on said radially outer surface of said cylinder structure for axial sliding movement along said cylinder structure;

a link structure extending between and having opposing ends pivotally connected to said collar and said vanes;

wherein at least one longitudinal edge of each of said vanes is located in overlapping relation to the vane surface of an adjacent vane when said vanes are in said first and second positions.

7. The adjustable vane system of claim 6, wherein said bearing cone includes a surface defining said inner wall of said exhaust flow passage, and said vanes are pivotally supported by said hinge structure at said cylinder structure to define said outer wall of said exhaust passage.

8. The adjustable vane system of claim 6, wherein said link structure comprises a plurality of link members.

9. An adjustable vane system for use in a turbomachine having a shaft extending longitudinally of said turbomachine, a plurality of rows of turbine blades mounted transversely of said shaft, a cylinder structure surrounding said turbine blades, a bearing cone surrounding an outer portion of said shaft, and an exhaust flow passage comprising inner and outer walls, the adjustable vane system comprising:

a plurality of movable vanes defining at least a portion of said outer wall of said exhaust flow passage, each said vane comprising a vane surface defined by a pair of longitudinal edges extending in an axial direction and a transverse edge extending between said longitudinal edges;

a hinge structure supporting said vanes at said cylinder structure for movement between at least first and second positions to change the cross-sectional area of the exhaust flow passage; and including a movable collar extending around at least a portion of said cylinder structure and a link structure extending between said collar and said vanes, said link structure comprising a plurality of link members, each said link member extending from a transverse hinge connection on a respective vane to a transverse hinge connection on said movable collar, wherein movement of said collar actuates said vanes to move between said first and second positions.

10. The adjustable vane system of claim 9, wherein said collar is supported on and slides along a radially outer surface of said cylinder structure, and movement of said movable collar axially along said cylinder structure causes said vanes to pivot radially about said hinge structure.

* * * * *